US009180699B2

(12) United States Patent
Iijima

(10) Patent No.: US 9,180,699 B2
(45) Date of Patent: Nov. 10, 2015

(54) IMAGE RECORDING APPARATUS

(75) Inventor: Shota Iijima, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 635 days.

(21) Appl. No.: 12/914,561

(22) Filed: Oct. 28, 2010

(65) Prior Publication Data

US 2011/0103867 A1 May 5, 2011

(30) Foreign Application Priority Data

Oct. 30, 2009 (JP) ..... 2009-250037

(51) Int. Cl.
*B41J 13/00* (2006.01)

(52) U.S. Cl.
CPC ..... *B41J 13/0018* (2013.01); *B41J 13/009* (2013.01)

(58) Field of Classification Search
CPC ... B41J 13/0018; B41J 13/0045; B41J 13/009
USPC ..... 400/188; 399/401; 101/230; 74/354; 271/291
See application file for complete search history.

(56) References Cited

U.S. PATENT DOCUMENTS 4,920,383 A * 4/1990 Cook ..... 399/304
5,055,885 A * 10/1991 Yoshikado et al. ..... 399/401
5,597,157 A * 1/1997 Hamilton et al. ..... 271/225
8,152,161 B2 * 4/2012 Samoto et al. ..... 271/186
2001/0040616 A1 11/2001 Uchida
2006/0228126 A1 * 10/2006 Nihei ..... 399/82
2006/0268089 A1 * 11/2006 Takeuchi ..... 347/104
2008/0240824 A1 10/2008 Asada

FOREIGN PATENT DOCUMENTS

JP H05-333632 A 12/1993
JP H10-026851 A 1/1998
JP 2007-217179 A 8/2007
JP 2008-247537 A 10/2008
JP 2009-154404 A 7/2009

OTHER PUBLICATIONS

Japan Patent Office, Decision to Grant for Japanese Patent Application No. 2008-247537 (counterpart to above-captioned patent application), mailed Mar. 12, 2013.

* cited by examiner

*Primary Examiner* — Jennifer Simmons
(74) *Attorney, Agent, or Firm* — Baker Botts L.L.P.

(57) ABSTRACT

An image recording device, including: a first sheet conveying path; a recording portion to record an image on a sheet; a first roller pair to convey the sheet in a first direction; a second sheet conveying path; a path changing portion; a second roller pair to convey the sheet in a second direction; a third roller pair to convey, to the first path, the sheet that has been conveyed to the second conveying path; and a control portion to control a sheet conveyance rate by the second roller pair to be higher than that by the third roller pair, whereby a part of the sheet between the second and third roller pairs is slacked for separating, from the second roller pair, a trailing end of the sheet before a leading end thereof reaches a position where the leading end is opposed to the recording portion in the first conveying path.

7 Claims, 8 Drawing Sheets

IMAGE RECORDING APPARATUS

CROSS REFERENCE TO RELATED APPLICATION

The present application claims priority from Japanese Patent Application No. 2009-250037, which was filed on Oct. 30, 2009, the disclosure of which is herein incorporated by reference in its entirety.

BACKGROUND OF THE INVENTION

1. Field of the Invention

The present invention relates to an image recording device configured to guide a sheet that is conveyed and to record an image on the sheet, and in particular to such an image recording device capable of recording images on both sides or opposite surfaces of the sheet.

2. Discussion of Related Art

There has been conventionally known an image recording device capable of recording images on both sides of a sheet. As one example of such an image recording device, there is known a duplex recording device in which a sheet fed from a tray is conveyed to a recording portion through a first conveying path by rollers of a roller pair (hereinafter referred to as a "first roller pair"). An image is recorded on a front surface of the sheet by the recording portion. The sheet whose front surface has been subjected to image recording by the recording portion is switchback-delivered to a second conveying path on a downstream side of the recording portion by rollers of another roller pair (hereinafter referred to as a "second roller pair"). The switchback-delivered sheet passes through the second conveying path and is subsequently conveyed back to the upstream side of the first roller pair in the first conveying path from the second conveying path by rollers of still another roller pair (hereinafter referred to as a "third roller pair") disposed in the second conveying path. The sheet conveyed back to the first conveying path is conveyed again to the recording portion by the first roller pair, and an image is recorded on a back surface of the sheet by the recording portion. Thereafter, the sheet in which the images have been recorded on both sides thereof is discharged outside the device by the second roller pair.

SUMMARY OF THE INVENTION

In recent years, there has arisen a strong demand for a cost reduction of the image recording device. As one method for the cost reduction, it is suggested to reduce the number of components used in the above-described duplex recording device by using a drive source and a drive transmission mechanism in common to both of the first roller pair and the second roller pair, for instance. In this instance, each roller of the first roller pair and each roller of the second roller pair are configured to rotate only in the same direction relative to each other. That is, the first roller pair and the second roller pair are configured such that the directions of rotation of the respective rollers of the first roller pair are the same as the directions of rotation of the corresponding rollers of the second roller pair. More specifically, when the first roller pair permits the sheet to be conveyed toward the downstream side, the second roller pair also permits the sheet to be conveyed toward the downstream side. On the other hand, when the first roller pair permits the sheet to be conveyed toward the upstream side, the second roller pair also permits the sheet to be conveyed toward the upstream side (toward the second conveying path).

Recently, the image recording device is downsized, and the image recording device capable of performing duplex printing is no exception. Where the above-described device which is capable of performing duplex printing and in which the drive source and the drive transmission mechanism are common to both of the first and second roller pairs is downsized, there may arise the following problem since the size of the sheet on which an image is recorded is unchanged even if the device is downsized.

In the above-described device, when the image recording on the back surface of the sheet starts after the image recording on the front surface has been finished, the sheet is in a state in which a leading end portion of the sheet is held by the rollers of the first roller pair, a middle portion of the sheet is located in the second conveying path, and a trailing end portion of the sheet is held by the rollers of the second roller pair. When the image recording on the back surface of the sheet starts in this state, the sheet is conveyed toward the downstream side by the first roller pair. In this instance, the rollers of the second roller pair configured to rotate only in the respective directions which are the same as the directions of rotation of the corresponding rollers of the first roller pair are rotated not in a direction to cause the sheet to be conveyed to the second conveying path, but in a direction to cause the sheet to be conveyed toward the downstream side. Accordingly, the sheet held by the rollers of the second roller pair needs to be pulled by the rollers of the third roller pair such that the trailing end of the sheet is forcibly pulled out from the rollers of the second roller pair. When the sheet is forcibly pulled by the third roller pair from the second roller pair, there may be caused a change in a load that acts on the sheet and a change in the sheet conveyance speed, at the instant the sheet is pulled out from the second roller pair. On this occasion, if the image recording on the back surface of the sheet is being conducted, there may be a risk that the image recorded on the sheet suffers from a blur or the like.

It is therefore an object of the invention to provide an image recording device capable of performing duplex image recording without suffering from image deterioration due to a change in a load that acts on a sheet, a change in a sheet conveyance speed, etc., when duplex recording is performed.

The above-indicated object may be attained according to a principle of the invention, which provides an image recording device, comprising:

- a first conveying path through which a sheet is conveyed;
- a recording portion configured to record an image on the sheet conveyed through the first conveying path;
- a first roller pair constituted by two rollers which are disposed on an upstream side of the recording portion in a first conveyance direction in the first conveying path and which are configured to rotate in one of a forward direction and a reverse direction so as to convey the sheet in the first conveyance direction;
- a second conveying path through which the sheet is conveyed from a downstream side of the recording portion in the first conveyance direction in the first conveying path toward an upstream side of the first roller pair in the first conveyance direction in the first conveying path;
- a path changing portion disposed on the downstream side of the recording portion in the first conveyance direction in the first conveying path and configured to be selectively placed in one of a first posture in which the sheet that has passed the recording portion is allowed to be further conveyed toward the downstream side and a second posture in which the sheet is allowed to be switchback-delivered to the second conveying path;

a second roller pair constituted by two rollers which are disposed on a downstream side of the path changing portion in the first conveyance direction in the first conveying path, which are configured to rotate in the same direction as the rollers of the first roller pair, and which are configured to rotate in one of a forward direction and a reverse direction so as to convey the sheet in the first conveyance direction and configured to rotate in the other of the forward direction and the reverse direction so as to convey the sheet in a second conveyance direction opposite to the first conveyance direction;

a third roller pair constituted by two rollers which are disposed in the second conveying path and which are configured to rotate so as to convey the sheet in a third conveyance direction, thereby conveying, to the first conveying path, the sheet that has been conveyed to the second conveying path by the rollers of the second roller pair and the path changing portion; and a control portion configured to control the rollers of the second roller pair and the rollers of the third roller pair such that conveyance of the sheet by the rollers of the second roller pair to be executed at a higher rate than a rate at which conveyance of the sheet by the rollers of the third roller pair is executed, whereby the sheet is conveyed in such a manner that a part thereof between the second roller pair and the third roller pair is slacked so as to separate, from the rollers of the second roller pair, a trailing end of the sheet that is conveyed through the second conveying path before a leading end of the sheet reaches a position at which the leading end of the sheet is opposed to the recording portion in the first conveying path.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

Figure 1:
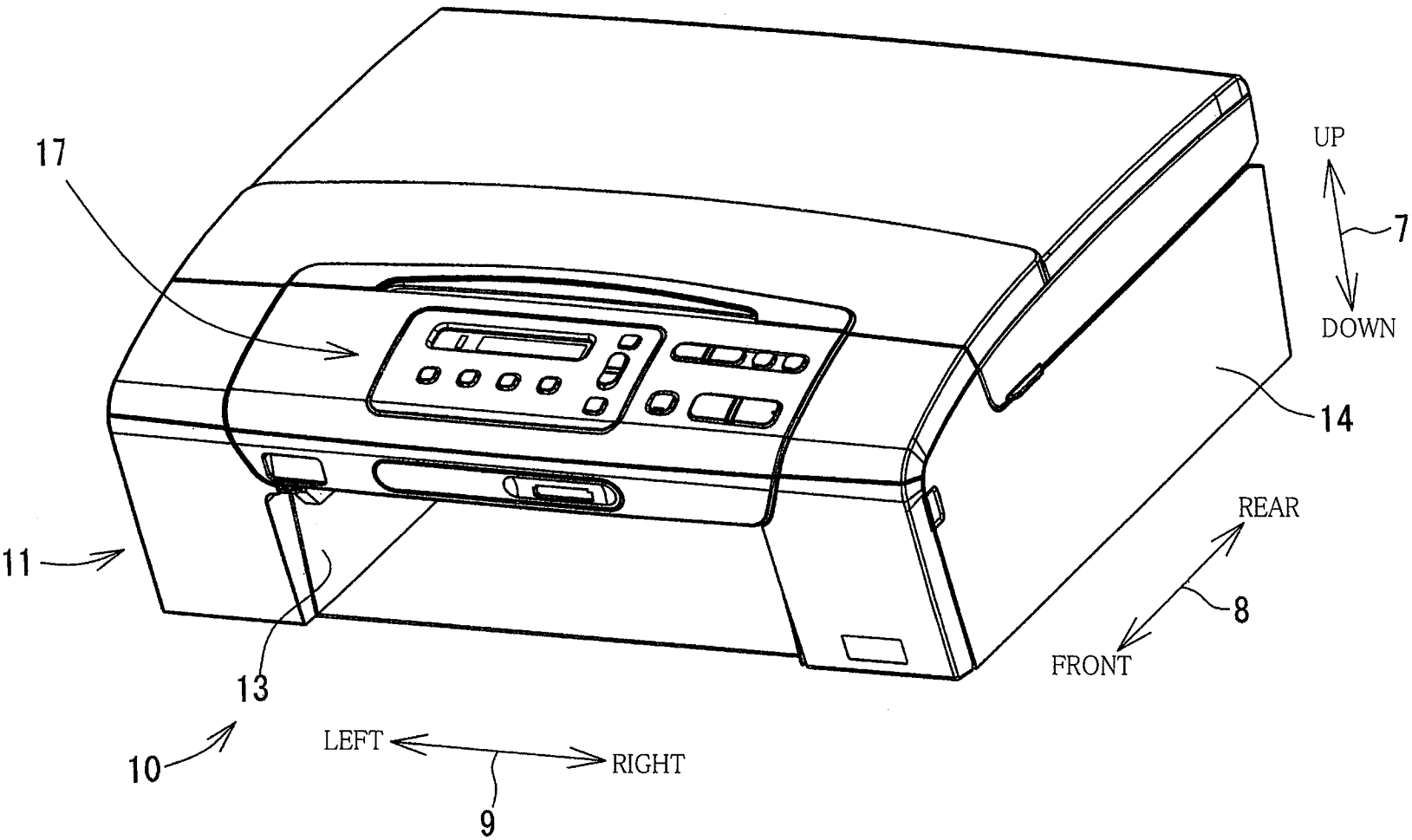
FIG. 1 is an external perspective view of a multi-function device according to one embodiment of the invention.

There will be hereinafter described embodiments of the invention with reference to the drawings. It is to be understood that the invention is not limited to the details of the embodiments described below, but may be embodied with various changes and modifications, which may occur to those skilled in the art, without departing from the spirit and scope of the invention defined in the attached claims. Referring first to the external perspective view of FIG. 1, there will be explained a multi-function device 10 as an image recording device according to one embodiment of the invention. In the following explanation, an up-down direction 7 is defined with reference to the orientation of the multi-function device 10 that is disposed for use as shown in FIG. 1. A front-rear direction 8 is defined with reference to a front side of the device 10 on which an opening 13 is provided. A left-right direction 9 is defined in a state in which the device 10 is seen from the front side.

The multi-function device 10 has a generally thin parallelepiped shape and has a printer portion 11 of an ink-jet recording type at a lower portion thereof. The multi-function device 10 has various functions such as a facsimile function and a printing function. As the printing function, the multi-function device 10 has a duplex image recording function of recording images on both sides or opposite surfaces of a recording sheet. Other functions except the printing function are optional. The printer portion 11 has a casing 14 in which the opening 13 is formed on the front side. A sheet cassette 78 equipped with a tray 20 for holding the recording sheets of various sizes (each as a sheet) is insertable into and withdrawable from the opening 13 in the front-rear direction 8. At the upper portion on the front side of the multi-function device 10, there is provided an operation panel 17 as an input portion for operating the printer portion 11. The multi-function device 10 operates on the basis of input through the operation panel 17.

<Structure of Printer Portion 11>

Figure 2:
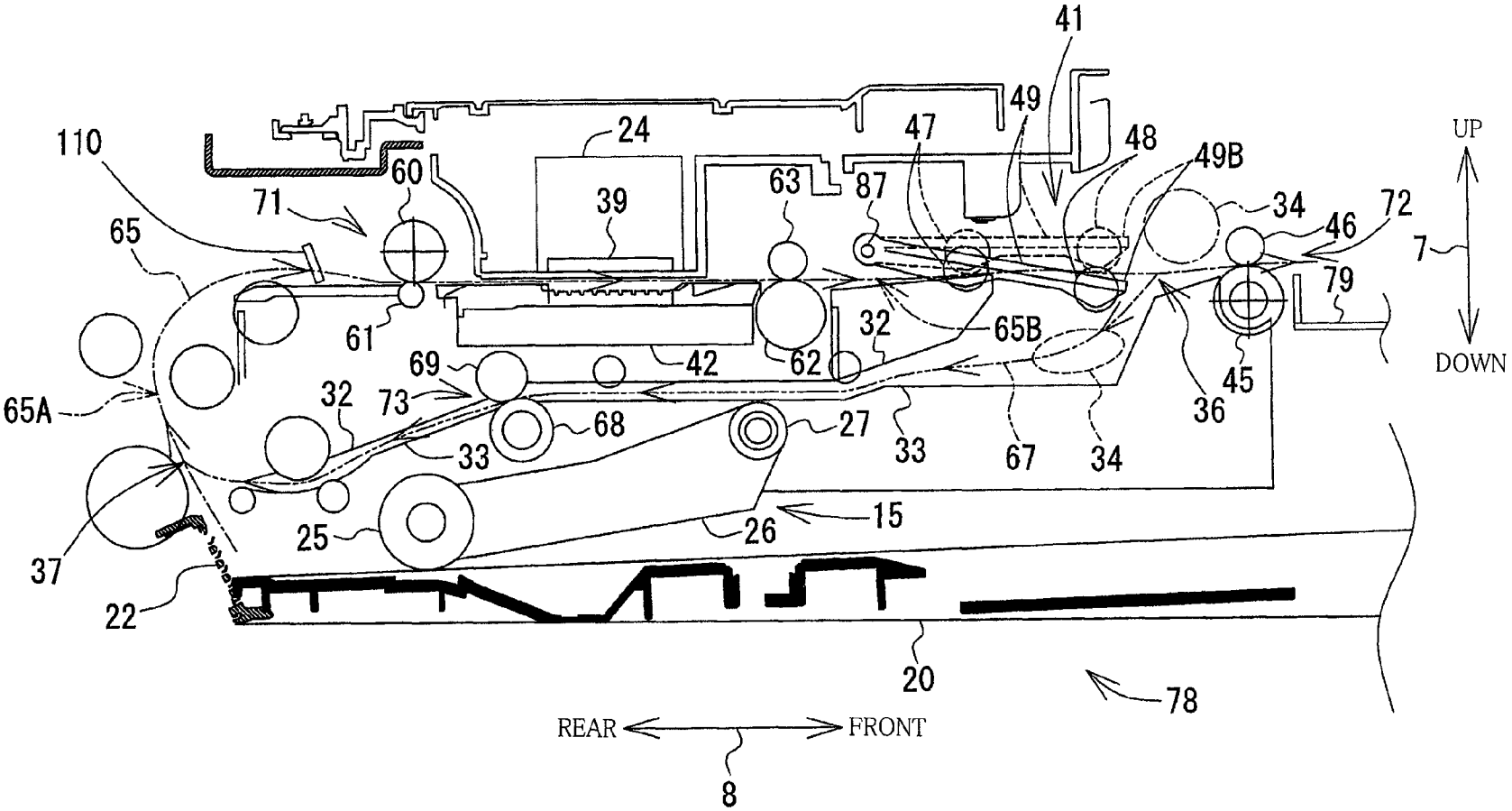
FIG. 2 is a view in vertical cross section schematically showing an internal structure of a printer portion of the multi-function device.

Referring next to FIG. 2, the structure of the printer portion 11 will be explained. In FIG. 2, the front side of the sheet cassette 78, i.e., the right-hand side of the sheet cassette 78 in FIG. 2, is not illustrated.

The printer portion 11 includes: a sheet feed portion 15 configured to pick up and feed an uppermost one of the recording sheets in the sheet cassette 78; a recording portion 24 of an ink-jet recording type for recording an image by ejecting ink droplets on the recording sheet fed by the sheet feed portion 15; and a path changing portion 41. The recording portion 24 is not limited to the ink-jet type, but may be of various types such as an electrophotographic type.

<Sheet Conveying Path 65>

There is formed, inside the printer portion 11, a sheet conveying path 65 as a first conveying path that extends from a distal end portion of the tray 20 (i.e., a rear-side end portion of the tray 20) and reaches a discharged-sheet receiving portion 79, via the recording portion 24. The sheet conveying path 65 is divided into a curved path portion 65A extending from the distal end portion of the tray 20 to the recording portion 24 and a discharge path portion 65B extending from the recording portion 24 to the discharged-sheet receiving portion 79. The recording sheet is conveyed through and guided in the sheet conveying path 65.

The curved path portion 65A is a curved path extending from the vicinity of an upper end of an inclined separation plate 22 disposed on the tray 20 to the recording portion 24. The discharge path portion 65B is a generally straight path extending from a downstream side of the recording portion 24 in a first conveyance direction to the discharged-sheet receiving portion 79. Here, the first conveyance direction is a direction in which the recording sheet is conveyed through the sheet conveying path 65 and is indicated by the long dashed short dashed line with the arrows in FIG. 2. Except a portion of the sheet conveying path 65 at which the recording portion 24 and so on are disposed, the sheet conveying path 65 is defined by an outer guide member and an inner guide member (both not shown) that are disposed so as to be opposed to each other with a suitable distance therebetween.

A branch opening 36 is formed on the downstream side of the recording portion 24 in the first sheet conveyance direction. When duplex image recording is performed, the recording sheet conveyed through the discharge path portion 65B is switchback-delivered to a reverse conveying path 67 as a second conveying path that will be explained, on a downstream side of the branch opening 36.

<Recording Portion 24>

The recording portion 24 is disposed above the sheet cassette 78 and reciprocates in a main scanning direction, namely, in a direction perpendicular to the sheet plane of FIG. 2. A platen 42 for horizontally supporting the recording sheet is disposed below the recording portion 24. During the reciprocating movement of the recording portion 42 in the main scanning direction, the recording portion 24 ejects, from nozzles 39, ink supplied from ink cartridges not shown to the recording sheet conveyed on the platen 42. Thus, an image is recorded on the recording sheet.

A first conveying roller 60 and a pinch roller 61 are disposed between a downstream end of the curved path portion 65A and the recording portion 24. The pinch roller 61 is disposed below the first conveying roller 60 and is held in pressing contact with a roller surface of the first conveying roller 60 by an elastic member (not shown) such as a spring. That is, the first conveying roller 60 and the pinch roller 61 form a pair and constitute a first roller pair 71. The rollers 60, 61 of the first roller pair 71 sandwich, therebetween, the recording sheet conveyed through the curved path portion 65A and send the recording sheet onto the platen 42.

A second conveying roller 62 and a spur roller 63 are disposed between the recording portion 24 and an upstream end of the discharge path portion 65B. The rollers 62, 63 form a pair. Like the pinch roller 61 of the first roller pair, the spur roller 63 is held in pressing contact with a roller surface of the second conveying roller 62. The second conveying roller 62 and the spur roller 63 sandwich, therebetween, the recording sheet on which an image has been recorded and send the recorded sheet toward the downstream side, namely, toward the discharged-sheet receiving portion 79.

Figure 5:
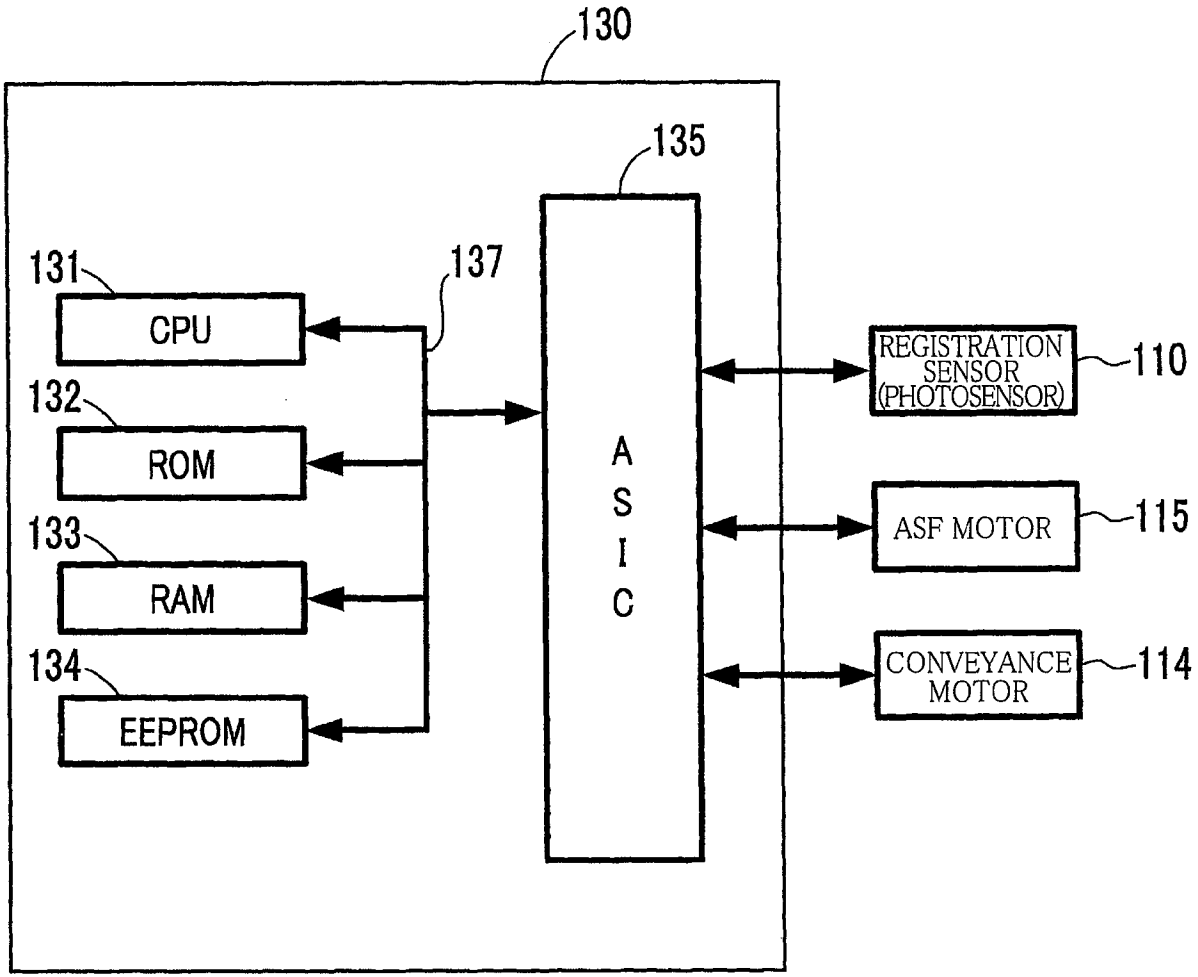
FIG. 5 is a block diagram showing a structure of a control portion.

The first conveying roller 60 and the second conveying roller 62 are rotated in a forward direction or a reverse direction by a drive force in a forward direction or a reverse direction transmitted from a conveyance motor 114 shown in FIG. 5. The rollers 60, 61 of the first roller pair 71 rotate in one of the forward direction and the reverse direction so as to convey the recording sheet in the first conveyance direction. In the present embodiment, when the conveyance motor 114 rotates in the forward direction, the first conveying roller 60 and the second conveying roller 62 are rotated in the forward direction, so that the recording sheet is conveyed in the first conveyance direction. On the other hand, when the conveyance motor 114 rotates in the reverse direction, the first conveying roller 60 and the second conveying roller 62 are rotated in the reverse direction.

<Sheet Feed Portion 15>

The sheet feed portion 15 is configured to feed the uppermost one of the recording sheets accommodated in the tray 20 toward the curved path portion 65A. The sheet feed portion 15 includes a feed roller 25, an arm 26, and a support shaft 27. The feed roller 25 is configured to pick up the uppermost one of the recording sheets in the tray 20 and subsequently feed the sheet to the curved path portion 65A. The feed roller 25 is rotatably supported at a distal end of the arm 26. The feed roller 25 is rotatably driven by a rotational force transmitted from an Auto Sheet Feed (ASF) motor 115 which is a drive source different from the conveyance motor 114. The ASF motor 115 rotates in one direction, and the feed roller 25 is rotated, owing to the rotation of the ASF motor 115, in a direction to cause the recording sheet to be fed to the curved path portion 65A. The arm 26 is supported at a proximal end thereof by the support shaft 27 and is pivotable about the support shaft 27 as a center of its pivotal movement. In the present embodiment, driving of the feed roller 25 and driving of a fourth conveying roller 68 (that will be described) by the ASF motor 115 are selectively changed in accordance with a position of the recording portion 24 in the main scanning direction as explained below in detail.

In the printer portion 11, there are disposed a switch lever, a switch gear, and two transmission gears (all of which are not shown). The switch lever is disposed in a movable range of the recording portion 24 within a non-recording region. When the recording portion 24 is moved to the non-recording region and comes into contact with the switch lever, the position of the switch lever is changed between a first switch position and a second switch position depending upon whether the recording portion 24 is located at a first position or a second position. The switch gear is configured to be slidable in the axial direction of a gear (not shown) to which drive is transmitted from the ASF motor 115 while meshing the gear. The switch gear slides in accordance with the switch position of the switch lever. That is, the switch gear slides to a first slide position when the switch lever is located at the first switch position and to a second slide position when the switch lever is located at the second switch position. One of the two transmission gears transmits drive to the feed roller 25 when the switch gear is located at the first slide position and the other of the two transmission gears transmits drive to the fourth conveying roller 68 when the switch gear is located at the second slide position.

<Registration Sensor 110>

There is provided, on the curved path portion 65A, a registration sensor 110 as a sheet detector for detecting a position of a leading end of the recording sheet conveyed through the curved path portion 65A. The registration sensor 110 detects a presence or an absence of the recording sheet conveyed through the sheet conveying path 65.

<Path Changing Portion 41>

The path changing portion 41 is disposed on the downstream side of the recording portion 24 in the first conveyance direction in the sheet conveying path 65. More specifically, the path changing portion 41 is disposed near the branch opening 36 in the discharge path portion 65B. The path changing portion 41 comprises a flap 49. The flap 49 extends from a support shaft 87 generally toward the downstream side and is pivotally supported by the support shaft 87 which is provided on a frame or the like of the printer portion 11 so as to extend in the direction perpendicular to the sheet plane of FIG. 2, namely, in the left-right direction 9 in FIG. 1. On the flap 49, auxiliary rollers 47, 48 are supported so as to be spaced apart from each other in the direction of extension of the flap 49. Since the roller surface of each of the auxiliary rollers 47, 48 is configured to come into contact with the recording surface of the recording sheet, the roller surface is formed as a spur like the spur roller 63 and a spur roller 46.

The flap 49 is configured such that its posture is changeable. More specifically, the flap 49 is configured to be pivotable so as to be selectively placed in one of a discharge posture (i.e., a first posture indicated by the broken line in FIG. 2) in which a distal end 49B of the flap 49 is located at a higher position than a lower guide member and a reverse posture (i.e., a second posture indicated by the solid line in FIG. 2) in which the distal end 49B of the flap 49 enters downward of the branch opening 36, namely, the distal end 49B of the flap 49 is located at a lower position than the branch opening 36. The recording sheet which has passed through the recording portion 24 is conveyed further toward the downstream side in the first conveyance direction when the flap 49 is placed in the discharge posture and is switch-back-delivered to the reverse conveying path 67 described below when the flap 49 is placed in the reverse posture.

<Second Roller Pair 72>

A third conveying roller 45 is disposed on the downstream side of the path changing portion 41 in the first conveyance direction in the sheet conveying path 65. The spur roller 46 is disposed above the third conveying roller 45 and is held in pressing contact with the roller surface of the third conveying roller 45 by its own weight, a spring or the like. That is, the third conveying roller 45 and the spur roller 46 form a pair so as to constitute a second roller pair 72. The third conveying roller 45 is rotated in the forward direction or the reverse direction by a drive force in the forward direction or the reverse direction transmitted from the conveyance motor 114. The rollers 45, 46 of the second roller pair 72 are configured to rotate in one of the forward direction and the reverse direction so as to convey the recording sheet in the first conveyance direction and configured to rotate in the other of the forward direction and the reverse direction so as to convey the recording sheet in a second conveyance direction opposite to the first conveyance direction.

In the present embodiment, when single side printing is performed, the third conveying roller 45 is rotated in the forward direction so that the recording sheet is discharged to the discharged-sheet receiving portion 79. On the other hand, when double side or duplex printing is performed, the conveyance motor 114 is rotated in the reverse direction with the recording sheet sandwiched by the rollers 45, 46 of the second roller pair 72, whereby the direction of rotation of the third conveying roller 45 is changed to the reverse direction from the forward direction. As a result, the recording sheet is conveyed in the second conveyance direction and is sent to the reverse conveying path 67 owing to the path changing portion 41 that is placed in the reverse posture. The third conveying roller 45 is configured to rotate in the same direction as the first conveying roller 60. That is, the directions of rotation of the respective rollers 45, 46 of the second roller pair 72 are identical with the directions of rotation of the corresponding rollers 60, 61 of the first roller pair 71.

<Reverse Conveying Path 67>

The reverse conveying path 67 is configured such that the recording sheet is conveyed therethrough from the downstream side of the recording portion 24 in the first conveyance direction in the conveying path 65 toward the upstream side of the first roller pair 71 in the first conveyance direction in the sheet conveying path 65. The reverse conveying path 67 is branched from the discharge path portion 65B at the branch opening 36, passes above the sheet cassette 78, and merges with the curved path portion 65A at a merge portion 37 that is located more upstream than the recording portion 24 in the first conveyance direction. The reverse conveying path 67 is defined by an upper inclined guide member 32 and a lower inclined guide member 33 that are disposed so as to be opposed to each other with a predetermined distance therebetween for allowing the recording sheet to pass therebetween.

<Third Roller Pair 73>

The fourth conveying roller 68 and a spur roller 69 are disposed in the reverse conveying path 67. The spur roller 69 is disposed above the fourth conveying roller 68 and is held in pressing contact with the roller surface of the fourth conveying roller 68 by its own weight, a spring or the like. The fourth conveying roller 68 and the spur roller 69 form a pair so as to constitute a third roller pair 73. The rollers 68, 69 of the third roller pair 73 are configured to rotate so as to convey the recording sheet in a third conveyance direction and to send or guide, to the conveying path 65, the recording sheet that has been conveyed to the reverse conveying path 67 by the second roller pair 72 and the path changing portion 41. Here, the third conveyance direction is a direction in which the recording sheet is conveyed through the reverse conveying path 67, i.e., a direction indicated by the long dashed double-short dashed line with arrows in FIG. 2.

Like the feed roller 25, the fourth conveying roller 68 is configured to be rotatably driven by a rotational force transmitted from the ASF motor 115. The ASF motor 115 is rotated in one direction and the fourth conveying roller 68 is rotated, by the rotation of the ASF motor 115, in a direction to cause the recording sheet to be conveyed in the third conveyance direction.

As shown in FIG. 2, there is formed a space 34 (indicated by the circle in the broken line) between the second roller pair 72 and the third roller pair 73 in the reverse conveying path 67, for accommodating the recording sheet that is slacked by a sheet conveyance control explained below. The space 34 is formed such that the distance between the lower inclined guide member 33 and the upper inclined guide member 32 is enlarged at a position of the reverse conveying path 67 at which the space 34 is provided. The space 34 may be provided in the sheet conveying path 65, not in the reverse conveying path 67. In this instance, the space 34 is provided as indicated by the circle in the long dashed and short dashed line in FIG. 2, such that the outer guide member (not shown) disposed on the upper side of the discharge path portion 65B is disposed at a higher position.

<Control Portion 130>

Referring next to FIG. 5, there will be explained a structure of a control portion 130. The invention is realized by the control portion 130 such that the sheet conveyance control according to a flow chart that will be explained is executed by the control portion 130.

The control portion 130 controls overall operations of the multi-function device 10 and is constituted by a microcomputer mainly including a CPU 131, a ROM 132, a RAM 133, an EEPROM 134, and an ASIC 135 which are connected by an internal bus 137. The ROM 132 stores programs for controlling various operations of the multi-function device 10. The RAM 133 is utilized as a region in which are temporarily stored data, signals and the like used in the execution of the programs by the CPU 131. The EEPROM 134 stores settings, flags and the like that should be retained after power is turned off. To the ASIC 135, there are connected the registration sensor 110, the ASF motor 115, the conveyance motor 114 and the like. The ASIC 135 incorporates: a circuit for detecting the state of the registration sensor 110; and a drive circuit for controlling the ASF motor 115 and the conveyance motor 114.

<Sheet Conveyance Control>

In the printer portion 11 constructed as described above, the sheet conveyance control is executed by the control portion 130. More specifically, in the sheet conveyance control, when images are recorded on both sides of the recording sheet, the conveyance of the recording sheet by the second roller pair 72 is executed at a higher rate than a rate at which the conveyance of the recording sheet by the third roller pair 73 is executed, and the recording sheet is conveyed such that a part thereof between the second roller pair 72 and the third roller pair 73 is slacked, so that the trailing end of the recording sheet that is being conveyed through the reverse conveying path 67 is separated from the rollers 45, 46 of the second roller pair 72 before the leading end of the recording sheet reaches a position at which the leading end of the sheet is opposed to the recording portion 24 in the sheet conveying path 65. Hereinafter, the procedure of the sheet conveyance control will be explained referring to the flow chart of FIG. 6.

The following explanation relates to a case in which the sheet conveyance by the second roller pair 72 is executed at the higher rate than the rate of the sheet conveyance by the third roller pair 73, by stopping the rollers 68, 69 of the third roller pair 73 at a predetermined timing. In the case that will be explained, the initial state of the path changing portion 41 is the reverse posture. Further, the recording portion 24 is movable among the following four positions in the main scanning direction: a first position at which drive is transmitted from the ASF motor 115 to the feed roller 25; a second position at which drive is transmitted from the ASF motor 115 to the fourth conveying roller 68; a third position at which an image is recorded on the recording sheet; and a neutral position at which drive is transmitted to neither the feed roller 25 nor the fourth conveying roller 68 from the ASF motor 115. The initial state of the recording portion 24 is the first position.

When an instruction to perform duplex printing is inputted through the operation panel 17 by a suitable operation, the ASF motor 115 is driven in the forward direction and the feed roller 25 is driven in the forward direction. Further, the conveyance motor 114 is driven in the forward direction and the rollers 60, 62, 45 are driven in the forward direction (S10). Owing to the forward rotation of the feed roller 25, the uppermost one of the recording sheets 74 on the tray 20 is picked up and fed toward the curved path portion 65A (S20).

Figure 7A:
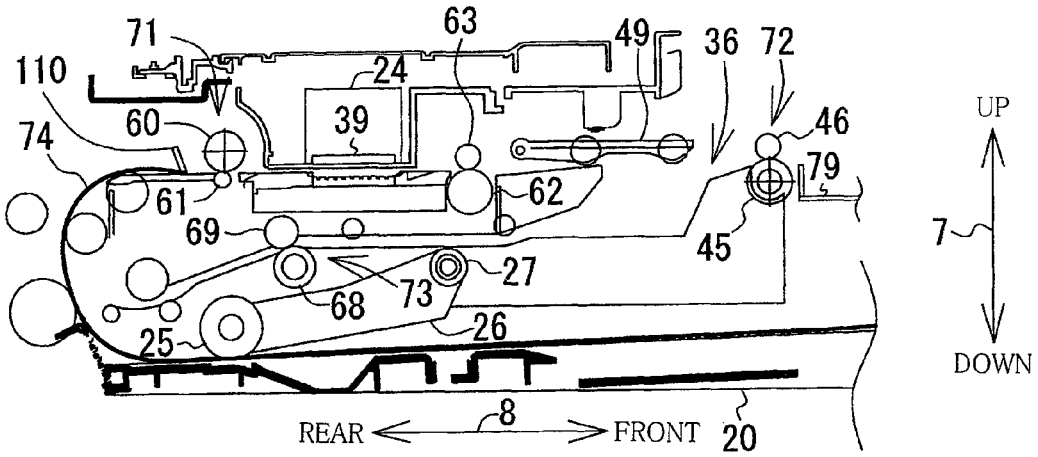
FIGS. 7A-7C are views schematically showing a state in which duplex recording is performed at the printer portion.

When the leading end of the recording sheet 74 reaches the registration sensor 110, the registration sensor 110 detects the recording sheet as shown in FIG. 7A (S30). When a predetermined time has elapsed after the detection of the recording sheet 74 by the registration sensor 110 and it is judged that the recoding sheet 74 has been held by the rollers 60, 61 of the first roller pair 71, the recording portion 24 is moved to the neutral position and the feed roller 25 is stopped (S40).

Thereafter, when the recording sheet 74 is conveyed onto the platen 42, the recording portion 24 is moved to the third position and an image is recorded on the front surface of the recording sheet (S50). When the trailing end of the recording sheet 74 passes the registration sensor 110 during or after the image recording, the recording sheet is not detected by the registration sensor 110 (S60).

Figure 7B:
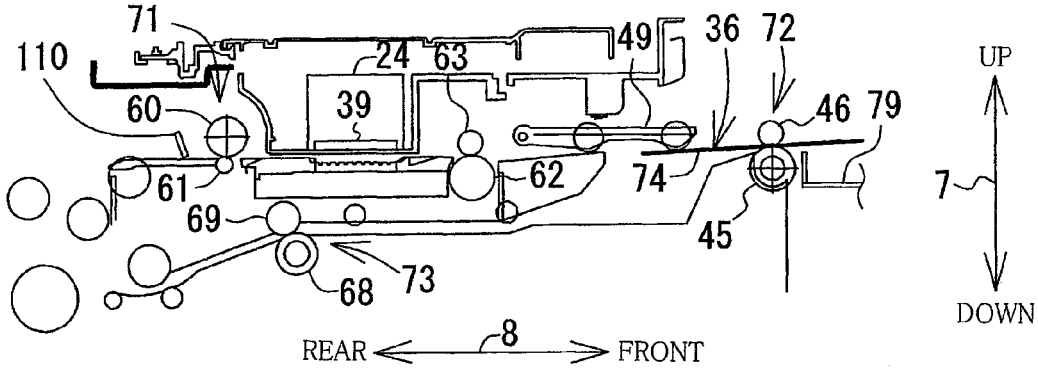
Figure 7C:
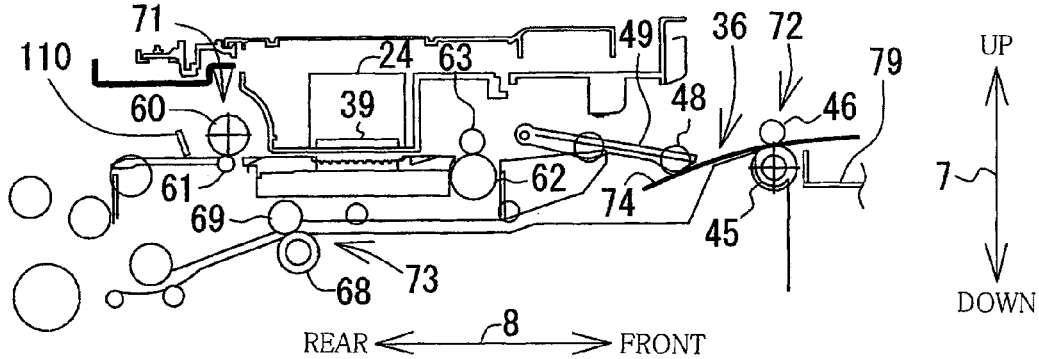

When the leading end of the recording sheet 74 that has passed below the recording portion 24 reaches the path changing portion 41, the path changing portion 41 is pushed up by the sheet 74, whereby the posture of the path changing portion 41 is changed from the reverse posture to the discharge posture. Since the third conveying roller 45 is rotated in the forward direction with the path changing portion kept at the discharge posture, the recording sheet 74 is conveyed toward the discharged-sheet receiving portion 79. The posture of the path changing portion 41 is changed from the discharge posture to the reverse posture (S70) at a timing when the trailing end of the recording sheet 74 reaches a specific position on the upstream side of the auxiliary roller 48 as shown in FIG. 7B. Accordingly, the trailing end of the sheet 74 is pushed downward by the auxiliary roller 48 and is directed toward the reverse conveying path 67 as shown in FIG. 7C.

Thereafter, the recording portion 24 is moved to the second position, and the chive that has been transmitted from the ASF motor 115 to the feed roller 25 is switched so as to be transmitted to the fourth conveying roller 68 (S80). In this state, the direction of rotation of the conveyance motor 114 is changed from the forward direction to the reverse direction, and the direction of rotation of each of the first conveying roller 60, the second conveying roller 62, and the third conveying roller 45 is changed from the forward direction to the reverse direction (S90).

Figure 8A:
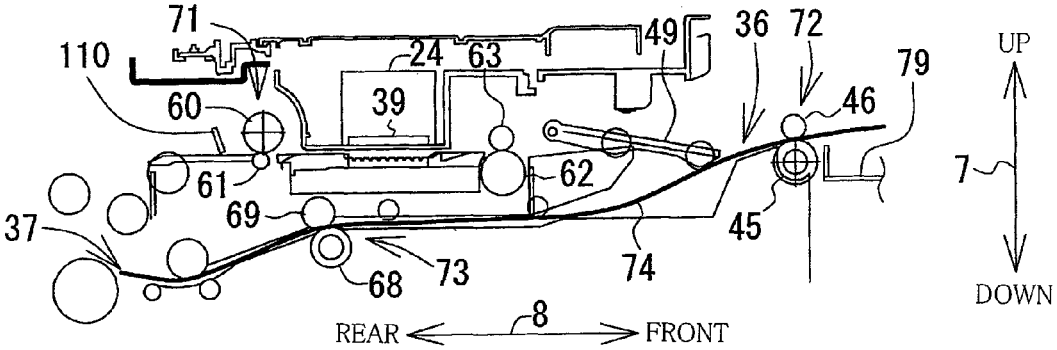
FIGS. 8A-8C are views schematically showing a state in which duplex recording is performed at the printer portion.

As a result, the conveyance direction of the recording sheet 74 is changed from the first conveyance direction to the second conveyance direction, whereby the recording sheet 74 is switchback-delivered to the reverse conveying path 67 owing to the path changing portion 41. The recording sheet switchback-delivered to the reverse conveying path 67 is conveyed in the third conveyance direction while being held by the rollers 68, 69 of the third roller pair 73 and is subsequently sent to the merge portion 37 as shown in FIG. 8A (S100).

Figure 8B:
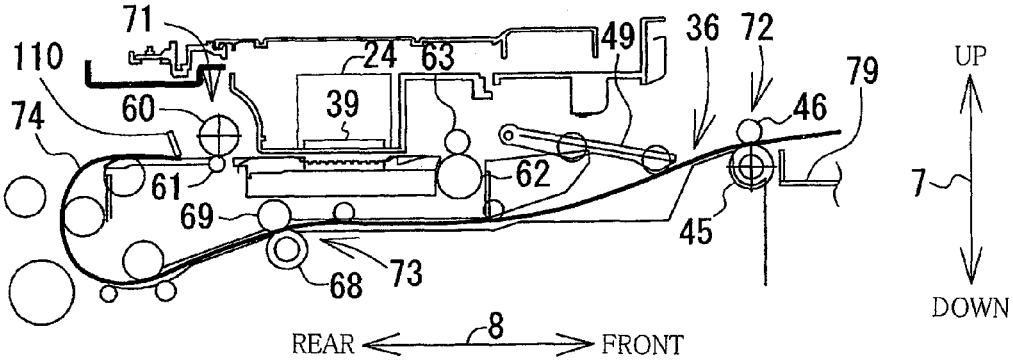

When the leading end of the sheet 74 that has been again sent to the sheet conveying path 65 reaches the registration sensor 110, the registration sensor 110 detects the sheet 74 as shown in FIG. 8B (S110).

In an instance where it is judged that the size of the recording sheet 74 is not identical with a predetermined size (e.g., an A4 size in the present embodiment) for which the sheet conveyance control is to be executed (S120: NO), the direction of rotation of the conveyance motor 114 is changed from the reverse direction to the forward direction and the direction of rotation of each of the rollers 60, 62, 45 is changed from the reverse direction to the forward direction (S130).

The judgment of the size of the recording sheet 74 is conducted as follows. The control portion 130 calculates the length of the recording sheet 74 as measured in a direction in which the sheet 74 is conveyed in the multi-function device 10, on the basis of information including: a time (referred to as a "fourth time") from a time point when the registration sensor 110 starts detecting the presence of the sheet 74 to a time point when the registration sensor 110 finishes detecting the presence of the sheet 74 (namely, a time elapsed before the detection of the sheet 74 by the registration sensor 110 ceases after the detection of the sheet 74 by the registration sensor 110 has started); and the rotational amount of the rollers of at least one of the roller pairs 71, 72, 73 in the fourth time. The fourth time is a time between a time point when the detection of the recording sheet 74 by the registration sensor 110 starts in S30 and a time point when the detection of the recording sheet 74 by the registration sensor 110 ceases in S60. The rotational amount of each roller is a rotational amount thereof within a prescribed time (referred to as a "fifth time") detected by a rotary encoder (not shown) disposed in the vicinity of each roller 60, 62, 45, 68, for instance. Namely, the rotational amount of each roller in the fifth time is a rotational speed thereof. There is calculated a conveyance distance of the recording sheet 74 within the fifth time, i.e., a conveyance speed, from the detected rotational amount and the circumferential length of at least one roller. On the basis of the fourth time and the calculated conveyance distance, the length of the recording sheet 74 in the conveyance direction is calculated. The control portion 130 is configured to perform a comparison between the calculated length of the recording sheet 74 and information as to the length, as measured in the conveyance direction, of a recording sheet with the A4 size stored in the ROM 132 or the like and to judge that the recording sheet 74 has the A4 size where the calculated length is identical with the stored information as to the length and to judge that the recording sheet 74 does not have the A4 size where the calculated length is not identical with the stored information as to the length.

Thereafter, the recording sheet 74 is conveyed onto the platen 42, the recording portion 24 is moved to the third position, and an image is recorded on the back surface of the recording sheet 74 (S140). The recording sheet 74 whose opposite surfaces have been subjected to image recording is discharged from the sheet conveying path 65 to the discharged-sheet receiving portion 79 (S150).

On the other hand, where it is judged in S120 that the length of the recording sheet 74 in the conveyance direction is the A4 size (S120: Yes), the recording portion 24 is moved to the neutral position, the transmission of the drive from the ASF motor 115 to the fourth conveying roller 68 is stopped, and the driving of the fourth conveying roller 68 is stopped (S160). In the present embodiment, the timing of stopping of the fourth conveying roller 68 is equal to the timing when the leading end of the recording sheet 74 reaches the registration sensor 110. The timing of stopping of the fourth conveying roller 68 is not limited to that described above. For instance, the stop timing of the fourth conveying roller 68 may be a timing when a prescribed time elapses after the leading end of the recording sheet 74 has reached the registration sensor 110, for instance. Here, the prescribed time is a time period between a time point at which the leading end of the recording sheet 74 passes the registration sensor 110 and a time point immediately before the leading end of the recording sheet 74 reaches onto the platen 42 that is opposed to the recording portion 24. As explained above, the control portion 130 determines whether the rollers 68, 69 of the third roller pair 73 need to be stopped or not on the basis of the calculated length of the recording sheet 74 in the conveyance direction, namely, the control portion 130 controls the third roller pair 73.

When the fourth conveying roller 68 is stopped in S160, a forward portion of the recording sheet 74 that is located on the upstream side, in the conveyance direction, of an intermediate portion thereof that is sandwiched by the rollers 68, 69 of the third roller pair 73 is stopped from being conveyed while a backward portion of the recording sheet 74 that is located on the downstream side, in the conveyance direction, of the intermediate portion continues to be conveyed by the rollers 45, 46 of the second roller pair 72 to which the drive is transmitted from the conveyance motor 114. The conveyance of the backward portion of the recording sheet 74 by the second roller pair 72 continues until the trailing end of the recording sheet 74 comes out of the second roller pair 72 (S170). That is, the control portion 130 controls the second roller pair 72 on the basis of the calculated length of the recording sheet 74 in the conveyance direction. A time period required for the backward portion of the recording sheet 74 to come out of the second roller pair 72 can be calculated from the calculated length of the recording sheet 74 in the conveyance direction, a distance between the third roller pair 73 and the registration sensor 110 (namely, the length of the above-indicated forward portion of the recording sheet 74), a distance between the third roller pair 73 and the second roller pair 72, the conveyance speed of each roller, and the like.

Figure 8C:
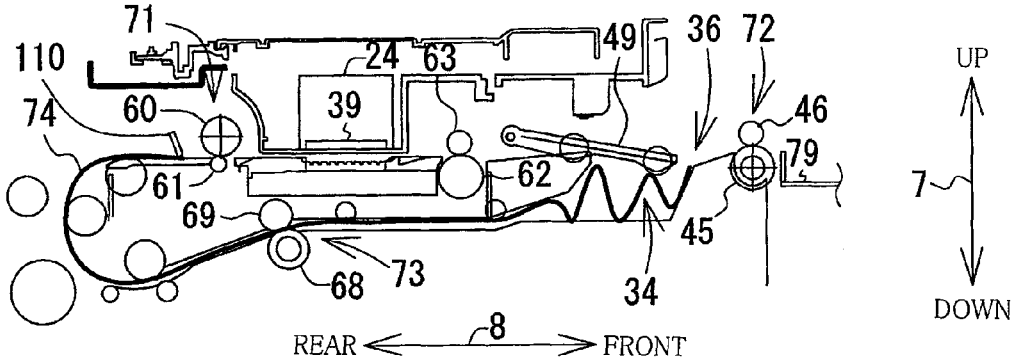

Since the rollers 68, 69 of the third roller pair 73 are kept stopped, the backward portion of the recording sheet 74 that is conveyed to the reverse conveying path 67 by the second roller pair 72 is slacked between the third roller pair 73 and the second roller pair 72 in the reverse conveying path 67. The slacked portion of the sheet 74 is accommodated in the above-described space 34 as shown in FIG. 8C.

When the trailing end of the recording sheet 74 comes out of the second roller pair 72 (S170: Yes), the recording portion 24 is moved to the second position so that the drive transmission from the ASF motor 115 to the fourth conveying roller 68 is restarted, whereby the driving of the fourth conveying roller 68 is restarted (S180). Thus, the control portion 130 controls the second roller pair 72 and the third roller pair 73 such that, before the leading end of the sheet 74 that is conveyed through the reverse conveying path 67 comes into contact with the rollers 60, 61 of the first roller pair 71, the trailing end of the recording sheet 74 is separated from the second roller pair 72. The control portion 130 controls the rollers 68, 69 of the third roller pair 73 to be once stopped before the leading end of the recording sheet 74 that is conveyed through the reverse conveying path 67 comes into contact with the rollers 60, 61 of the first roller pair 71 and to control the rollers 68, 69 of the third roller pair 73 to be again driven after the trailing end of the recording sheet 74 has been separated from the rollers 45, 46 of the second roller pair 72. Thereafter, the processing similar to that in S130-S150 is executed.

In the illustrated embodiment, the rollers 68, 69 of the third roller pair 73 are stopped before the leading end of the recording sheet that is conveyed through the reverse conveying path 67 comes into contact with the rollers 60, 61 of the first roller pair 71. Further, the third roller pair 73 is disposed in the reverse conveying path 67 through which the recording sheet is conveyed from the second roller pair 72 toward the first roller pair 71. Accordingly, the recording sheet is not conveyed further toward the first roller pair 71 from the third roller pair 73 in the reverse conveying path 67 after the rollers 68, 69 of the third roller pair 73 have been stopped. Therefore, the leading end of the recording sheet can be prevented from coming into contact with the rollers 60, 61 of the first roller pair 71.

In the illustrated embodiment, the rollers 68, 69 of the third roller pair 73 are driven after the trailing end of the recording sheet has been separated from the rollers 45, 46 of the second roller pair 72, whereby the recording sheet 74 held by the rollers 45, 46 of the second roller pair 72 is prevented from being forcibly pulled out of the second roller pair 72 by the third roller pair 73. That is, when an image is being recorded on the recording sheet by the recording portion 24, the trailing end of the sheet is not pulled out of the second roller pair 72. Accordingly, the arrangement avoids the change in the load and the change in the sheet conveyance speed which may be otherwise caused, so that it is possible to realize duplex image printing without suffering from image deterioration due to the change in the load and the change in the sheet conveyance speed.

In the illustrated embodiment, even where the length of the recording sheet as measured in the conveyance direction is larger than the distance between the second roller pair 72 and the first roller pair 71 via the reverse conveying path 67, an excess portion of the recording sheet that extends beyond the above-indicated distance between the second roller pair 72 and the first roller pair 71 can be accommodated in the space 34. Accordingly, it is possible to reduce the probability of occurrence of paper jams in the multi-function device 10.

In the illustrated embodiment, the control portion 130 needs information as to the length of the recording sheet in the conveyance direction for executing the sheet conveyance control. The control portion 130 calculates the time from the time point when the registration sensor 110 starts detecting the recording sheet to the time point when the registration sensor 110 finishes detecting the sheet 74, on the basis of the detection result of the registration sensor 110. Subsequently, the control portion 130 calculates the speed at which the recording sheet is conveyed on the basis of information as to the rotational amount of the rollers of at least one of the roller pairs 71, 72, 73 in the calculated time period. On the basis of the thus calculated time and speed, the control portion 130 calculate the length of the recording sheet in the conveyance direction.

Modified Embodiment 1

In the illustrated embodiment, the rollers 68, 69 of the third roller pair 73 are stopped at the predetermined timing, whereby the sheet conveyance by the second roller pair 72 is executed at the higher rate than the rate at which the sheet conveyance by the third roller pair 73 is executed.

Figure 6:
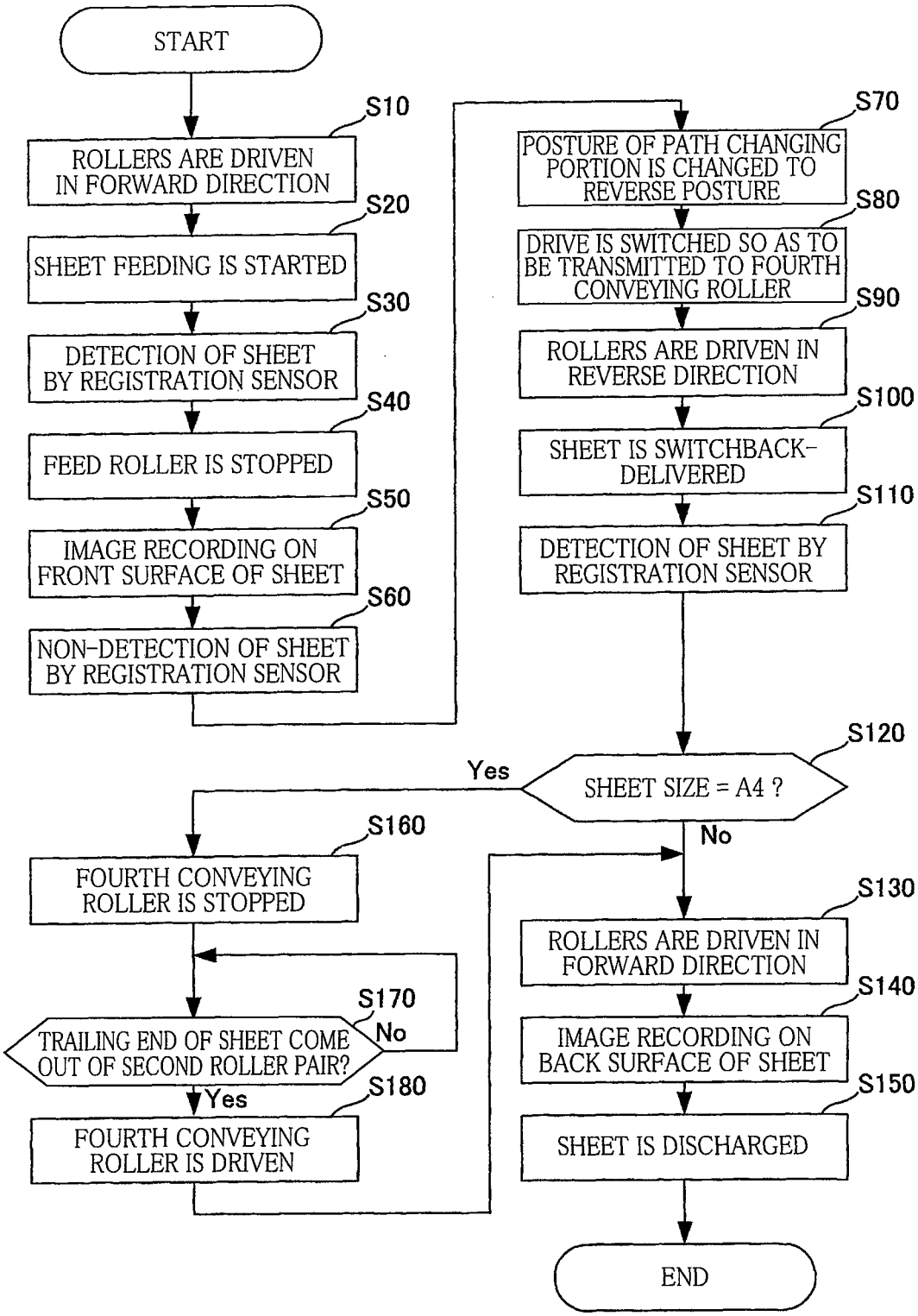
FIG. 6 is a flow chart showing one example of a procedure of a sheet conveyance control executed by the control portion.

However, where the trailing end of the recording sheet that is conveyed through the reverse conveying path 67 can be separated from the rollers 45, 46 of the second roller pair 72 before the leading end of the sheet reaches the position at which the leading end is opposed to the recording portion 24 in the conveying path 65 or reaches the position at which the leading end of the sheet comes into contact with the rollers 60, 61 of the first roller pair 71, the rollers 68, 69 of the third roller pair 73 may be kept driven without being stopped in step S160 of the control flow shown in FIG. 6. In this instance, the following method may be practiced for permitting the sheet conveyance by the second roller pair 72 to be executed at the higher rate than the rate of the sheet conveyance by the third roller pair 73. For instance, the control portion 130 may be configured to control the rollers 68, 69 of the third roller pair 73 to be rotated at a circumferential speed lower than that of the rollers 45, 46 of the second roller pair 72. More specifically, the control portion 130 may be configured to control the conveyance motor 114 and the ASF motor 115 to rotate the third conveying roller 45 at a higher speed than that of the fourth conveying roller 68. Alternatively, a gear ratio of the fourth conveying roller 68 may be made larger than that of the third conveying roller 45.

In the illustrated embodiment, a time (referred to as a "first time") from a time point when the leading end of the recording sheet passes through the third roller pair 73 to a time point when the leading end of the sheet reaches the position at which the leading end of the sheet is opposed to the recording portion 24 is determined by a sheet conveyance speed by the third roller pair 73 and the distance between the third roller pair 73 and the position at which the leading end of the sheet is opposed to the recording portion 24 in the conveying path 65. Further, a time (referred to as a "second time") from a time point when the leading end of the recording sheet passes through the third roller pair 73 to a time point when the trailing end of the recording sheet passes through the second roller pair 72 is determined by a sheet conveyance speed by the second roller pair 72 and the length of a portion of the recording sheet that does not yet pass through the second roller pair 72 when the leading end of the sheet passes through the third roller pair 73. In this respect, the sheet conveyance speed by the second roller pair 72 or the third roller pair 73 corresponds to the circumferential speed of each roller of the second roller pair 72 or the third roller pair 73.

Accordingly, by determining the sheet conveyance speed by the third roller pair 73 and the sheet conveyance speed by the second roller pair 72 such that the second time is shorter than the first time, the trailing end of the recording sheet that is conveyed through the reverse conveying path 67 is separated from the second roller pair 72 before the leading end of the sheet that is conveyed through the reverse conveying path 67 reaches the position at which the leading end of the sheet is opposed to the recording portion 24 in the conveying path 65.

In the illustrated embodiment, a time (referred to as a "third time") from a time point when the leading end of the recording sheet passes through the third roller pair 73 to a time point when the leading end of the sheet comes into contact with the first roller pair 71 is determined by the sheet conveyance speed by the third roller pair 73 and the distance between the third roller pair 73 and the first roller pair 71. Further, the second time is determined in a manner similar to that described above.

Accordingly, by determining the sheet conveyance speed by the third roller pair 73 and the sheet conveyance speed by the second roller pair 72 such that the second time is shorter than the third time, the trailing end of the recording sheet that is conveyed through the reverse conveying path 67 can be separated from the second roller pair 72 before the leading end of the sheet that is conveyed through the reverse conveying path 67 comes into contact with the first roller pair 71. According to the arrangement, the leading end of the recording sheet that is conveyed from the downstream side of the recording portion 24 in the first conveyance direction in the sheet conveying path 65 toward the upstream side of the first roller pair 71 in the first conveyance direction in the sheet conveying path 65, via the reverse conveying path 67, is prevented from coming into contact with the rollers 60, 61 of the first roller pair 71 that are being rotated in a direction to cause the recording sheet to be conveyed in the second conveyance direction. Therefore, when the recording sheet is conveyed for duplex image recording, it is possible to prevent the recording sheet from being stained and to prevent paper dust from being generated from the recording sheet.

Modified Embodiment 2

In the illustrated embodiment, the feed roller 25 and the fourth conveying roller 68 are configured to receive the drive transmitted from the ASF motor 115 while the first conveying roller 60, the second conveying roller 62, and the third conveying roller 45 are configured to receive the drive from the conveyance motor 114. The fourth conveying roller 68 may be configured to receive the drive from the conveyance motor 114.

The fourth conveying roller 68 conveys the recording sheet in the third conveyance direction. Where the fourth conveying roller 68 is configured to receive the drive from the conveyance motor 114, however, there may be a risk that fourth conveying roller 68 conveys the recording sheet in a direction opposite to the third conveyance direction depending upon the direction of rotation of the conveyance motor 114 since the conveyance motor 114 is configured to rotate in both of the forward direction and the reverse direction.

Figure 3:
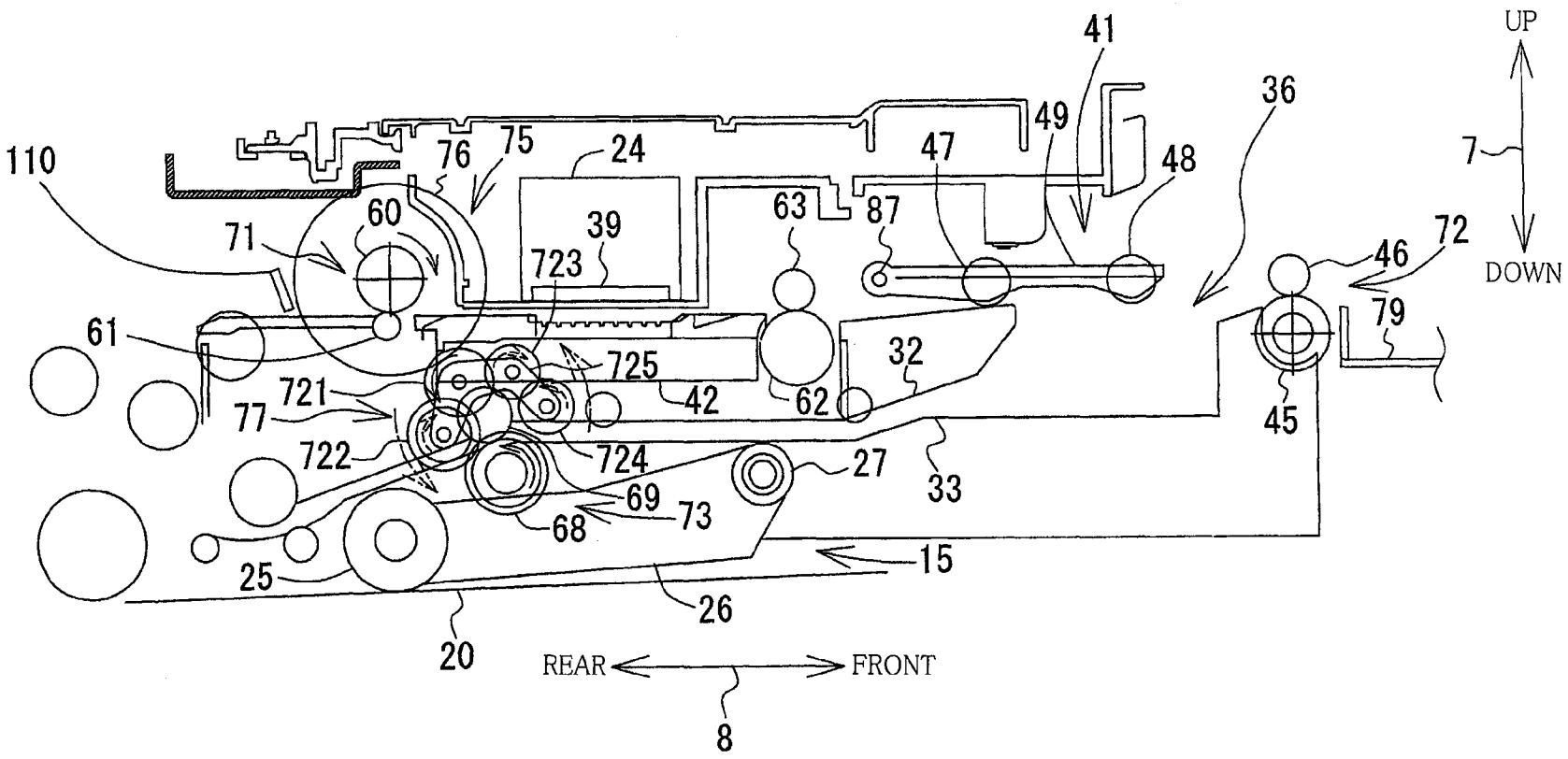
FIG. 3 is a view in vertical cross section schematically showing an internal structure of a printer portion of a multi-function device according to a modified embodiment of the invention.
Figure 4:
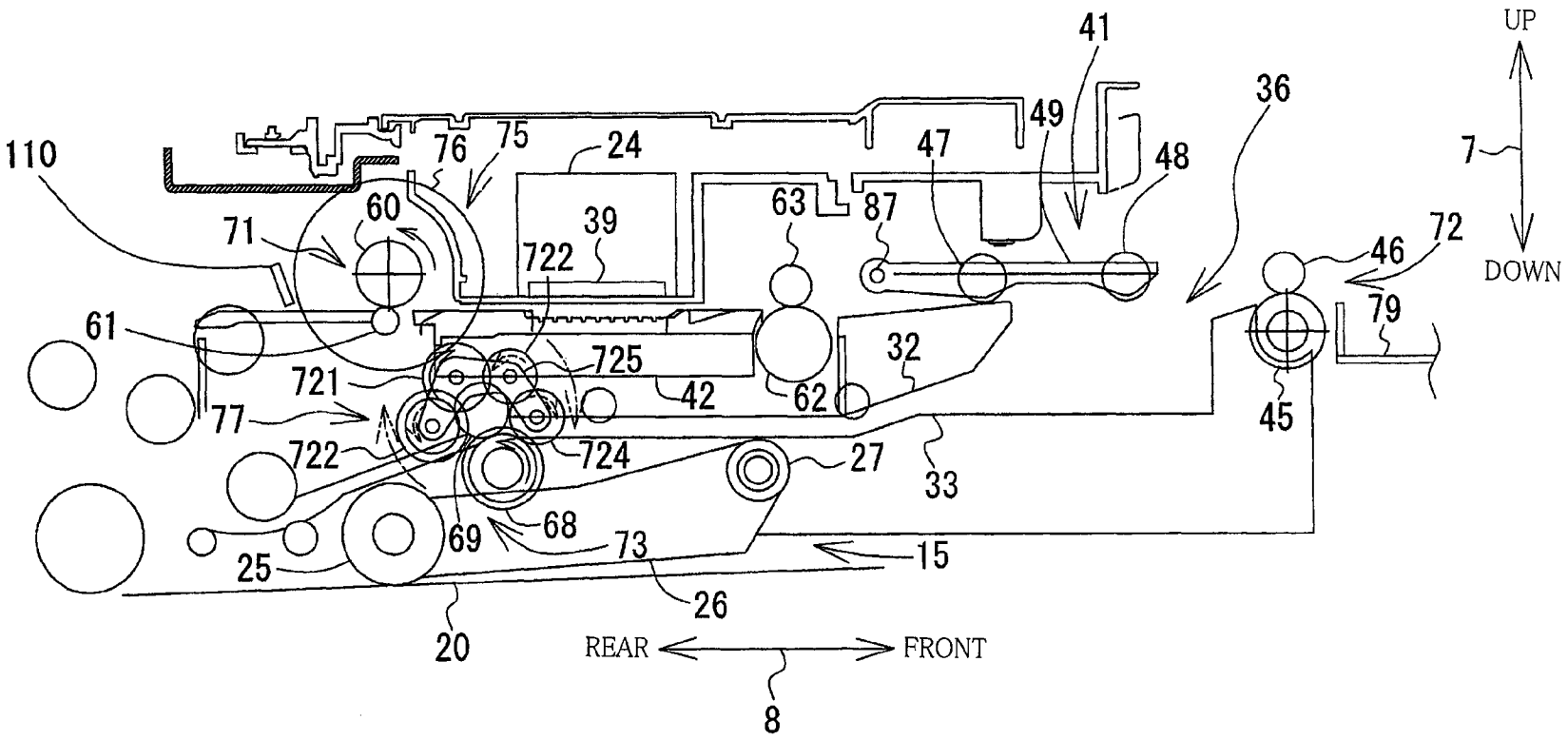
FIG. 4 is another view in vertical cross section schematically showing the internal structure of the printer portion of the multi-function device according to the modified embodiment of the invention.

In the modified embodiment 2, the printer portion 11 is equipped with a drive transmission mechanism 75 for permitting the fourth conveying roller 68 to convey the recording sheet constantly in the third conveyance direction without conveying the recording sheet in the direction opposite to the third conveyance direction, as explained below in detail. As shown in FIGS. 3 and 4, the fourth conveying roller 68 is configured to be rotated by a drive force in the forward direction transmitted from the conveyance motor 114 via the drive transmission mechanism 75 and to be rotated by a drive force in the reverse direction transmitted from the conveyance motor 114 via the drive transmission mechanism 75. The drive transmission mechanism 75 is coaxial with the first conveying roller 60 and is supported on the right or left side of the sheet conveying path 65. The drive transmission mechanism 75 comprises a gear assembly 77 and an intermediate gear 76 configured to rotate integrally with the first conveying roller 60.

The gear assembly 77 includes: a first transmission gear 721 meshing the intermediate gear 76; a second transmission gear 722 meshing the first transmission gear 721 and capable of meshing the fourth conveying roller 68; a third transmission gear 723 meshing the first transmission gear 721 and a fourth transmission gear 724; and the fourth transmission gear 724 meshing the third transmission gear 723 and capable of meshing the fourth conveying roller 68.

The first transmission gear 721 is supported so as to be rotatable about a shaft that extends from a side frame of the printer portion 11 or the like. Each of the transmission gears 721-724 is supported by a V-shaped plate member 725 so as to be rotatable about own axis. More specifically, the first transmission gear 721 is supported at a bent portion of the V-shaped plate member 725. The second transmission gear 722 and the fourth transmission gear 724 are supported at respective opposite end portions of the V-shaped plate member 725. The third transmission gear 723 is supported between the first transmission gear 721 and the fourth transmission gear 724. Thus, each of the transmission gears 722-724 is configured to be pivotable about the first transmission gear 721 as a pivot center.

As shown in FIGS. 3 and 4, when the first transmission gear 721 rotates in one of mutually opposite directions which are indicated by respective solid arrows in FIG. 3 and FIG. 4, by rotation of the first conveying rollers 60 and the intermediate gear 76 in a direction indicated by a solid arrow in each of FIG. 3 and FIG. 4, the second through fourth transmission gears 722-724 pivot in a direction indicated by a long dashed short dashed arrow about the first transmission gear 721 as a pivot center while rotate in directions indicated by respective broken arrows. As a result, the fourth conveying roller 68 rotates in a direction indicated by a solid arrow (in the same direction in both of FIG. 3 and FIG. 4) and cooperates with the spur roller 69 to hold, therebetween, the recording sheet conveyed to the reverse conveying path 67 by the second roller pair 72 and to convey the recording sheet in the third conveyance direction. Thus, the drive transmission mechanism 75 is configured to convey the recording sheet in the third conveyance direction irrespective of whether the first conveying roller 60 rotates in the forward direction or the reverse direction.

In the modified embodiment 2, it is possible to execute a sheet conveyance control by executing the control explained above with respect to the modified embodiment 1, i.e., the control in which the sheet conveyance speed by the second roller pair 72 is made higher than that by the third roller pair 73 and the rollers 68, 69 of the third roller pair 73 are kept driven without being stopped in S160 of the flow chart of FIG. 6. The procedure of the sheet conveyance control in the modified embodiment 3 differs from the sheet conveyance control in the illustrated embodiment in that the drive source of the fourth conveying roller 68 is the conveyance motor 114 and also differs in the following point.

More specifically, the judgment of the size of the recording sheet in S120 of the flow chart of FIG. 6 is not conducted, and the control flow directly goes to S130 from S110. Accordingly, S160-S180 are not implemented. As explained in the modified embodiment 1, in S130, since the sheet conveyance speed by the second roller pair 72 is higher than that by the third roller pair 73, the trailing end of the recording sheet that is conveyed through the reverse conveying path 67 is separated from the second roller pair 72 before the leading end of the sheet reaches the position at which the leading end of the sheet is opposed to the recording portion 24 or the position at which the leading end of the sheet comes into contact with the first roller pair 71.

Modified Embodiment 3

In the illustrated embodiment, the control portion 130 is configured to calculate the length of the recording sheet as measured in the direction in which the sheet is conveyed in the multi-function device 10, on the basis of the information including: the fourth time from the time point when the registration sensor 110 starts detecting the sheet to the time point when the registration sensor 110 finishes detecting the sheet 74; and the rotational amount of the rollers of at least one of the roller pairs 71, 72, 73 in the fourth time. The control portion 130 may be configured to judge the length of the recording sheet as measured in the direction in which the sheet is conveyed in the multi-function device 10 on the basis of the sheet size inputted through the operation panel 17 and to control the second roller pair 72 and the third roller pair 73 on the basis of the judged size of the recording sheet in the conveyance direction. For instance, the control portion 130 may be configured such that, when a specific sheet size is selected from various sheet sizes such as A4 and B5 displayed on a liquid crystal display provided on the operation panel 17, the control portion 130 is notified of the selected sheet size and judges the size of the recording sheet.

In the arrangement described above, the information as to the size of the recording sheet on which an image is to be recorded is given via the operation panel 17 to the control portion 130, whereby the control portion 130 can judge the length of the recording sheet in the conveyance direction from the sheet size information.

What is claimed is:

1. An image recording device, comprising:

a first conveying path configured to guide a sheet in a first conveyance direction;

a recording portion configured to record an image on the sheet as the sheet is conveyed through the first conveying path;

a first roller pair comprising two rollers disposed on an upstream side of the recording portion in the first conveying path, the first roller pair being configured to rotate in a forward direction to convey the sheet in the first conveyance direction;

a second conveying path configured to guide the sheet from a downstream side of the recording portion in the first conveying path toward an upstream side of the first roller pair in the first conveying path;

a second roller pair comprising two rollers disposed on a downstream side of the recording portion in the first conveying path, the second roller pair being configured to rotate in the forward direction to convey the sheet in the first conveyance direction and to rotate in a reverse direction to convey the sheet in a second conveyance direction opposite to the first conveyance direction;

a third roller pair comprising two rollers disposed in the second conveying path, the third roller pair being configured to rotate so as to convey the sheet in a third conveyance direction, such that the sheet that has been conveyed to the second conveying path by the second roller pair is conveyed to the first conveying path; and a control portion configured to control the second roller pair and the third roller pair to convey the sheet until a leading end of the sheet reaches a predetermined position between the third roller pair and the first roller pair after the leading end of the sheet has passed beyond an end of the third roller pair that is closer to the first roller pair, and then continuously rotate the rollers of the second roller pair until a trailing end of the sheet separates from the second roller pair in a state in which the rotation of the rollers of the third roller pair is stopped.

2. The image recording device according to claim 1, wherein the controller is configured to control the rollers of the third roller pair to again rotate after the trailing end of the sheet has been separated from the rollers of the second roller pair.

3. The image recording device according to claim 1, wherein a space is provided between the second roller pair and the third roller pair in at least one of the first conveying path and the second conveying path for accommodating the part of the sheet that is slacked.

4. The image recording device according to claim 1, further comprising a sheet detector for detecting a presence and an absence of the sheet that is conveyed in the first conveying path, wherein the controller is configured to calculate a length of the sheet as measured in a direction in which the sheet is conveyed in the device, based on information comprising:

a time period from a time point when the sheet detector starts detecting the presence of the sheet to a time point when the sheet detector finishes detecting the presence of the sheet; and a rotational amount of the rollers of at least one of the first roller pair, the second roller pair, and the third roller pair within the time period; and wherein the controller is further configured to control the rollers of the second roller pair and the rollers of the third roller pair based on the calculated length of the sheet.

5. The image recording device according to claim 1, further comprising an input portion configured to receive a size of the sheet as input, wherein the controller is configured to judge a length of the sheet as measured in a direction in which the sheet is conveyed in the device based on the size of the sheet input through the input portion and to control the rollers of the second roller pair and the rollers of the third roller pair based on the judged length of the sheet.

6. The image recording device according to claim 1, further comprising a path changing portion disposed on the downstream side of the recording portion in the first conveying path, the path changing portion being configured to be selectively placed in one of a first posture in which the sheet that has passed the recording portion is allowed to be further conveyed toward the downstream side of the recording portion and a second posture in which the sheet is allowed to be switchback-delivered to the second conveying path.

7. The image recording device according to claim 1, wherein the second roller pair is further configured to rotate in the same direction as the rollers of the first roller pair.

* * * * *